US009580820B2

(12) United States Patent
Hu et al.

(10) Patent No.: US 9,580,820 B2
(45) Date of Patent: Feb. 28, 2017

(54) SELF-BREATHING ELECTROCHEMICAL OXYGENERATOR

(71) Applicant: WUXI GREENSTEK CO., LTD, Wuxi, Jiangsu (CN)

(72) Inventors: Mingruo Hu, Jiangsu (CN); Akira Ogasawara, Jiangsu (CN); Guangyi Cao, Jiangsu (CN)

(73) Assignee: WUXI GREENSTEK CO., LTD, Wuxi, Jiangsu (CN)

( * ) Notice: Subject to any disclaimer, the term of this patent is extended or adjusted under 35 U.S.C. 154(b) by 116 days.

(21) Appl. No.: 14/389,738

(22) PCT Filed: Oct. 21, 2012

(86) PCT No.: PCT/CN2012/083264
§ 371 (c)(1),
(2) Date: Sep. 30, 2014

(87) PCT Pub. No.: WO2013/149465
PCT Pub. Date: Oct. 10, 2013

(65) Prior Publication Data

US 2015/0075974 A1 Mar. 19, 2015

(30) Foreign Application Priority Data

Apr. 1, 2012 (CN) ..... 2012 1 0095363

(51) Int. Cl.
*C25B 9/10* (2006.01)
*C25B 1/02* (2006.01)
(Continued)

(52) U.S. Cl.
CPC ..... *C25B 1/02* (2013.01); *C25B 9/00* (2013.01); *C25B 9/10* (2013.01); *C25B 15/02* (2013.01)

(58) Field of Classification Search
CPC ..... C25B 1/02–1/12
See application file for complete search history.

(56) References Cited

U.S. PATENT DOCUMENTS 4,456,008 A * 6/1984 Clawson ..... A61M 16/08 128/204.25
6,689,259 B1 * 2/2004 Klein ..... B01J 4/00 204/230.5

(Continued)

FOREIGN PATENT DOCUMENTS

CN 101967651 A * 2/2011
WO WO 2012/065524 A1 * 5/2012

OTHER PUBLICATIONS

Machine Translation of CN101967651.*

*Primary Examiner* — Harry D Wilkins, III

(57) ABSTRACT

A self-breathing electrochemical oxygenerator includes an outer housing including an upper housing part and a lower housing part. A cavity formed by the upper housing part includes a battery installation cavity, a controller installation cavity and an electrochemical assembly installation cavity. Batteries are installed within the battery installation cavity. A controller is installed within the controller installation cavity. A self-breathing electrochemical pure oxygen generation assembly is installed within the electrochemical assembly installation cavity. An upper housing body of the upper housing part corresponding to the electrochemical assembly installation cavity has air holes. After the external oxygen output pipe is blocked, through timely manual operation, the pressure within the pure oxygen generation assembly is ensured to fall within a normal range, so as to ensure that the pure oxygen generation assembly works normally, thereby ensuring long service life of the oxygenerator.

16 Claims, 7 Drawing Sheets

(51) Int. Cl.
*C25B 15/02* (2006.01)
*C25B 9/00* (2006.01)

(56) References Cited

U.S. PATENT DOCUMENTS

2003/0183179 A1* 10/2003 Lin ..... C25B 1/04
123/2
2004/0101723 A1* 5/2004 Kruppa ..... C25B 1/02
205/628
2007/0089997 A1* 4/2007 Depalo ..... C25B 1/06
205/335
2008/0282653 A1* 11/2008 Tempelman ..... A61G 11/00
55/385.2

* cited by examiner

SELF-BREATHING ELECTROCHEMICAL OXYGENERATOR

CROSS-REFERENCE TO RELATED APPLICATIONS

This PCT application is based on application No. 201210095363.9 filed in China on Apr. 1, 2012, the contents of which are incorporated hereinto by reference.

BACKGROUND OF THE PRESENT INVENTION

Field of Invention

The present invention relates to the technical field of electrochemical manufacturing pure oxygen, and more particularly to a self-breathing electrochemical oxygenerator.

Description of Related Arts

The existing self-breathing electrochemical oxygenerator with publication application No. CN101967651A filed on Oct. 15, 2010 is described as follows. It comprises an outer housing which comprises an upper housing part and a lower housing part. The lower housing part comprises a battery installation chamber, a controller installation chamber, and a pure oxygen generation assembly installation boss. A side wall of the lower housing part has the air hole. The pure oxygen generation assembly installation boss has the oxygen outlet. The oxygen outlet is communicated with an external joint. Batteries are installed within the battery installation chamber. A controller is installed within the controller installation chamber. The pure oxygen generation assembly is fixed to the pure oxygen generation assembly installation boss. A positive electrode and a negative electrode of the battery are respectively connected with a positive electrode and a negative electrode of an input end of the controller via leads. An anode wire and a cathode wire of the pure oxygen generation assembly are respectively connected with a positive electrode and a negative electrode of an output end of the controller. A power switch is mounted on the controller. The upper housing part is mounted on an upper end of the lower housing part. After the external oxygen output pipe in the above structure is blocked, the pressure within the pure oxygen generation assembly is over high, so that the oxygenerator is damaged, thus the service life of the oxygenerator is shortened.

SUMMARY OF THE PRESENT INVENTION

Aiming at the above mentioned problems, the present invention provides a self-breathing electrochemical oxygenerator, wherein after the external oxygen output pipe is blocked, through timely manual operation, the pressure within the pure oxygen generation assembly is ensured to fall within a normal range, so as to ensure that the pure oxygen generation assembly works normally, thereby ensuring long service life of the oxygenerator.

The technical solution of the self-breathing electrochemical oxygenerator is described as follows. The self-breathing electrochemical oxygenerator comprises an outer housing which comprises an upper housing part and a lower housing part, and is characterized in that: a cavity formed by the upper housing part comprises a battery installation cavity, a controller installation cavity and an electrochemical assembly installation cavity, batteries are installed within the battery installation cavity, a controller is installed within the controller installation cavity, a self-breathing electrochemical pure oxygen generation assembly is installed within the electrochemical assembly installation cavity, an upper housing body of the upper housing part corresponding to the electrochemical assembly installation cavity has air holes, an upper housing body of the upper housing part corresponding to the controller installation cavity has a display screen assembly hole, a positive electrode and a negative electrode of the battery installation cavity are respectively connected with a positive electrode and a negative electrode of an input end of the controller via leads, a power switch and a pressure sensor are mounted on the controller, an output end of the controller is connected with a display screen, the display screen is inserted into the display screen assembly hole, an anode pin of the pure oxygen generation assembly, a cathode pin thereof, and a pressure educing pipe are respectively connected with a positive electrode and a negative electrode of the output end of the controller, and an input end of the pressure sensor, an oxygen outlet of the pure oxygen generation assembly is communicated with the pressure educing pipe, the lower housing part is mounted on the upper housing part, a joint through-hole and a switch through-hole are respectively provided at two positions where the lower housing part is corresponding to an oxygen joint of the pure oxygen generation assembly and the lower housing part is corresponding to the power switch of the controller, the oxygen joint of the pure oxygen generation assembly penetrates through the joint through-hole of a top surface of the lower housing part, and the power switch of the controller penetrates through the switch through-hole of the top surface of the lower housing part.

Furthermore, it is characterized in that: a seal hose is sleevedly mounted to an outer surface of the pressure educing pipe exposing to the pure oxygen generation assembly and an outer surface of the input end of the pressure sensor, a guide tube is sleevedly mounted to an outer surface of the seal hose; a square hole is provided at a position where the lower housing part is corresponding to the battery installation cavity, a battery cover is mounted on the square; a temperature sensor and a humidity sensor are mounted on the controller; the pure oxygen generation assembly comprises a porous gas end plate, a membrane electrode assembly, an oxygen end plate, and a gas gathering base, the membrane electrode assembly comprises an anode gas diffusion layer, an anode catalytic layer, a proton exchange membrane, a cathode catalytic layer, and a cathode gas diffusion layer, the porous gas end plate, the membrane electrode assembly and the oxygen end plate are sealedly connected with each other in turn, a plurality of small holes are evenly distributed in a middle of the porous gas end plate and face to the cathode gas diffusion layer, the cathode gas diffusion layer is connected with the negative electrode of the output end of the external controller, an oxygen through-hole is provided at a middle of the oxygen end plate and is communicated with an oxygen output pipe, the anode gas diffusion layer is connected with the positive electrode of the output end of the external controller, an outer surface of a connecting portion of the membrane electrode assembly with the porous gas end plate and with the oxygen end plate has a package slot, the two package slots are filled with the adhesive; the cathode pin extends from the porous gas end plate; the anode pin extends from the oxygen end plate; a whole of the porous gas end plate connected with the membrane electrode assembly and the oxygen end plate is placed on the gas gathering base and is filled with the adhesive via the sealing groove of the gas gathering base for being packaged, the oxygen through-hole of the oxygen end plate is communicated with the oxygen outlet of the gas gathering base, the oxygen outlet is communicated with the oxygen joint, an outer surface of the anode gas diffusion layer and the anode catalytic layer of the packaged membrane electrode assembly has an anode package slot, an outer surface of a side where the porous gas end plate fits to the cathode gas diffusion layer has a cathode package slot; an outer surface of the anode gas diffusion layer and the anode catalytic layer of the packaged membrane electrode assembly has an inner anode package slot, an outer surface of a side where the oxygen end plate fits to the anode gas diffusion layer has an outer anode package slot, the inner anode package slot is communicated with the outer anode package slot to form a whole anode package slot, an outer surface of a side where the porous gas end plate fits to the cathode gas diffusion layer has a cathode package slot; the proton exchange membrane is embodied as a hydrogen ion exchange membrane.

Beneficial Effects

After using the structure of the present invention, the pressure educing pipe of the pure oxygen generation assembly transmits the pressure of the oxygen outlet to the pressure sensor, judges whether the blocked external oxygen output pipe causes the over high oxygen pressure within the base via the controller, if the pressure is over high, the controller cuts off the power supply for the pure oxygen generation assembly, the oxygen can't be further generated for ensuring that the pressure within the pure oxygen generation assembly will not break through the limit value, so as to ensure that the pure oxygen generation assembly will not be damaged, thereby ensuring long service life of the oxygenerator.

DETAILED DESCRIPTION OF THE PREFERRED EMBODIMENT

Figure 1:
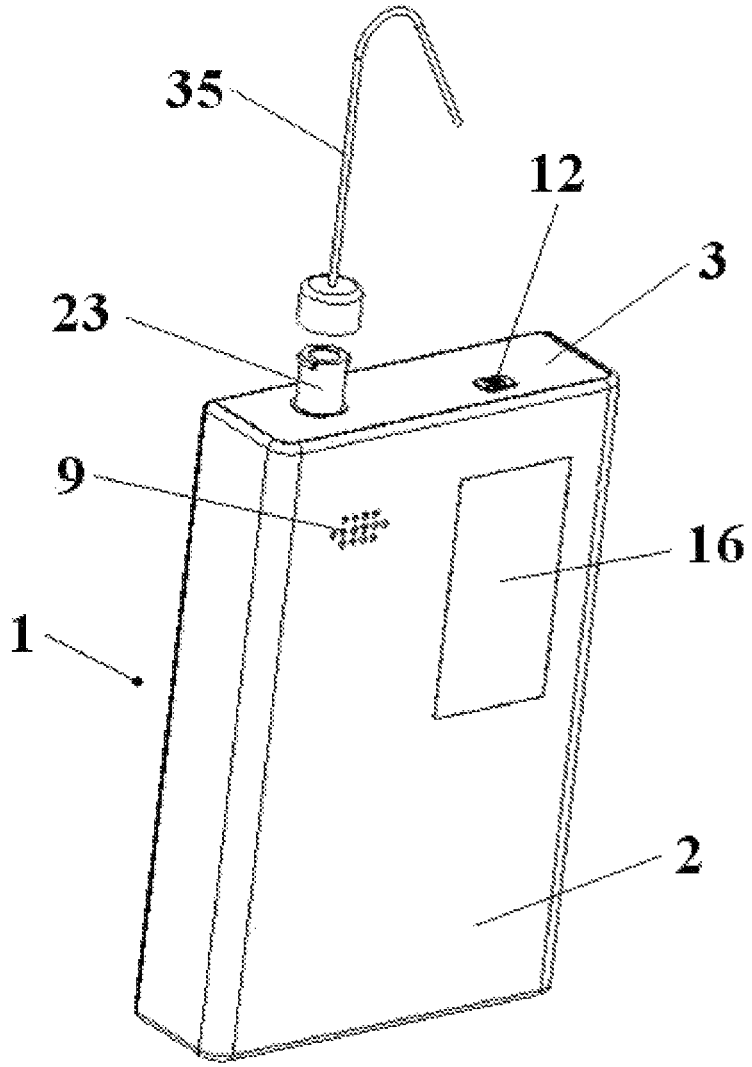
FIG. 1 is an outer structurally schematic view of the present invention.
Figure 2:
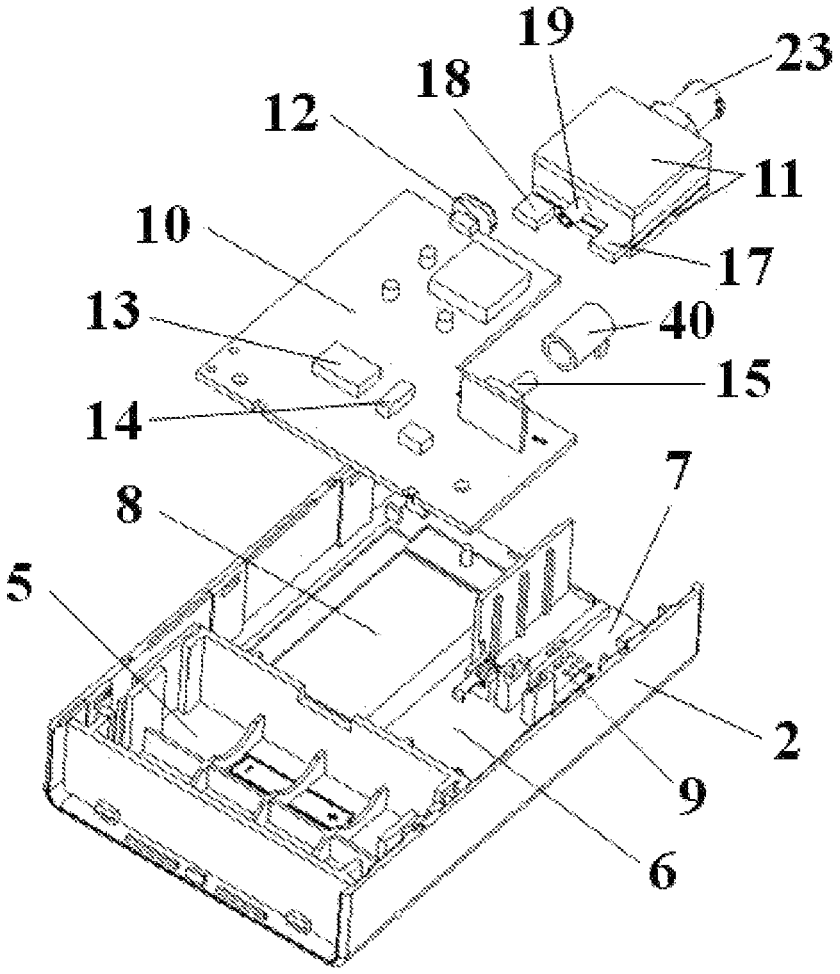
FIG. 2 is an inner structurally schematic view of an upper housing part of the present invention.
Figure 3:
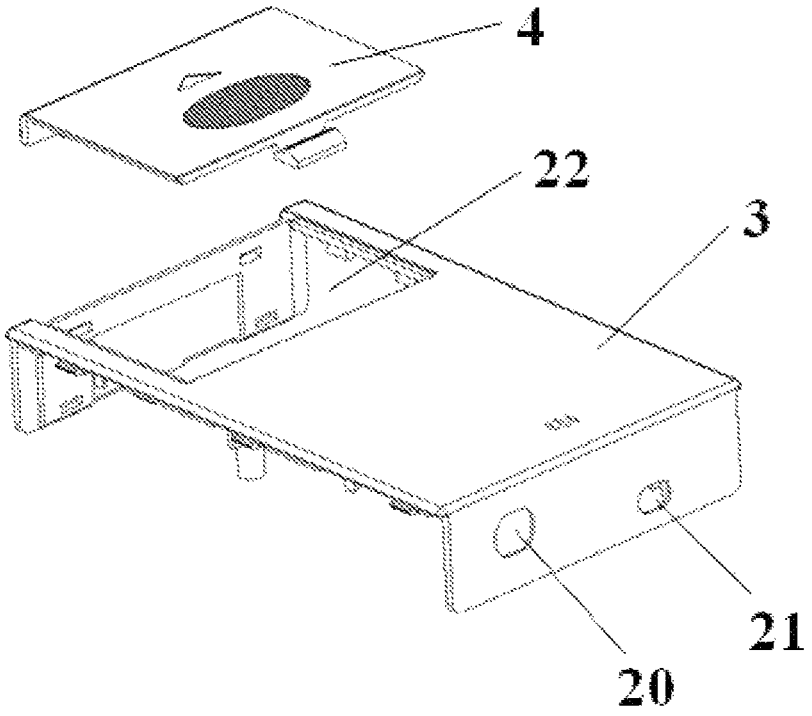
FIG. 3 is a structurally schematic view of a lower housing part and a battery cover of the present invention.

Referring to FIGS. 1-6, an electrochemical oxygenerator 1 comprises an outer housing which comprises an upper housing part 2, a lower housing part 3 and a battery cover 4. A cavity, formed by the upper housing part 2, comprises a battery installation cavity 5, a controller installation cavity 6 and an electrochemical assembly installation cavity 7. The upper housing part 2 has a display screen assembly hole 8 and air holes 9. Batteries are installed within the battery installation cavity 5. A controller 10 is installed within the controller installation cavity 6. A pure oxygen generation assembly 11 is installed within the electrochemical assembly installation cavity 7. An upper housing body of the upper housing part 2 corresponding to the electrochemical assembly installation cavity 7 has the air holes 9. An upper housing body of the upper housing part 2 corresponding to the controller installation cavity 6 has the display screen assembly hole 8. A positive electrode and a negative electrode of the battery installation cavity 5 are respectively connected with a positive electrode and a negative electrode of an input end of the controller 10 via leads. A power switch 12, a temperature sensor 13, a humidity sensor 14 and a pressure sensor 15 are mounted on the controller 10. An output end of the controller 10 is connected with a display screen 16. The display screen 16 is inserted into the display screen assembly hole 8. An anode pin 17 of the pure oxygen generation assembly 11, a cathode pin 18 thereof, and a pressure educing pipe 19 are respectively connected with a positive electrode and a negative electrode of the output end of the controller, and an input end of the pressure sensor 15. An oxygen outlet 38 of the pure oxygen generation assembly 11 is communicated with the pressure educing pipe 19. The lower housing part 3 is mounted on the upper housing part 2. A joint through-hole 20 and a switch through-hole 21 are respectively provided at two positions where the lower housing part 3 is corresponding to an oxygen joint 23 of the pure oxygen generation assembly 11 and the lower housing part 3 is corresponding to the power switch 12 of the controller 10. The oxygen joint 23 of the pure oxygen generation assembly 11 penetrates through the joint through-hole 20 of the lower housing part 3, and the power switch 12 of the controller 10 penetrates through the switch through-hole 21 of the lower housing part 3. A square hole 22 is provided at a position where the lower housing part 3 is corresponding to the battery installation cavity 5. The battery cover 4 is mounted on the square 22. A seal hose 39 is sleevedly mounted to an outer surface of the pressure educing pipe 19 exposing to the pure oxygen generation assembly 11 and an outer surface of the input end of the pressure sensor 15, and a guide tube 40 is sleevedly mounted to an outer surface of the seal hose 39.

Figure 4:
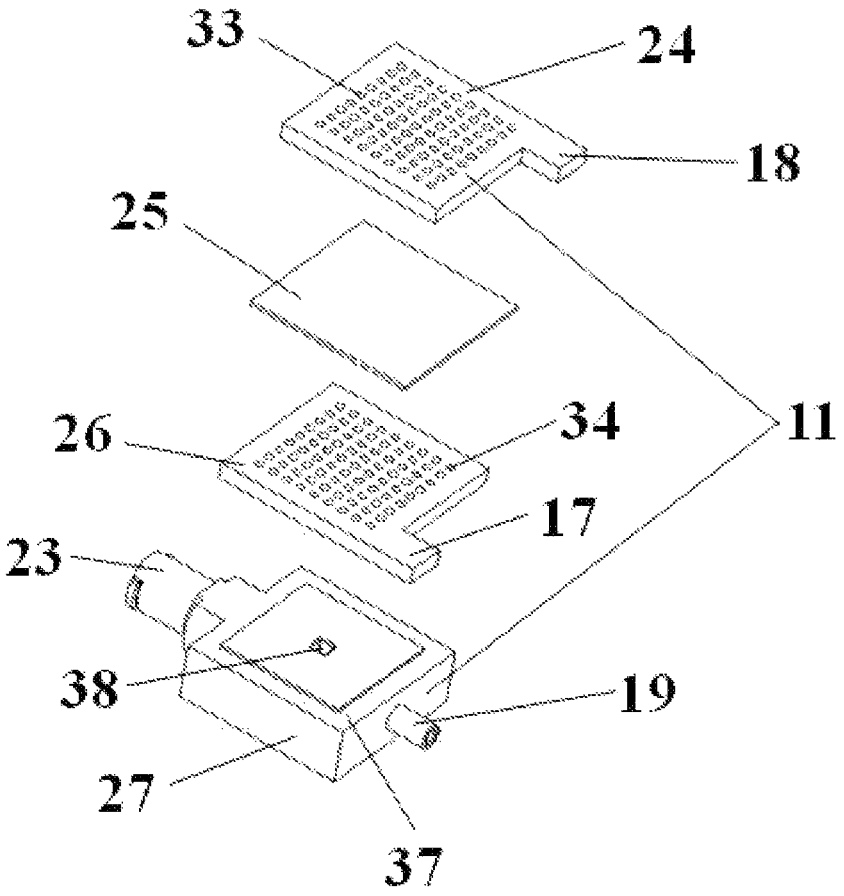
FIG. 4 is a structurally schematic diagram of a pure oxygen generation assembly of the present invention.
Figure 5:
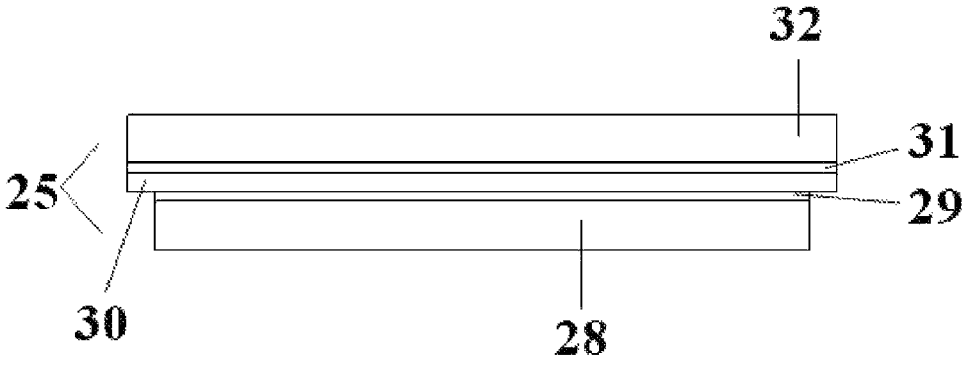
FIG. 5 is a structurally schematic diagram of a membrane electrode assembly of the present invention.
Figure 6:
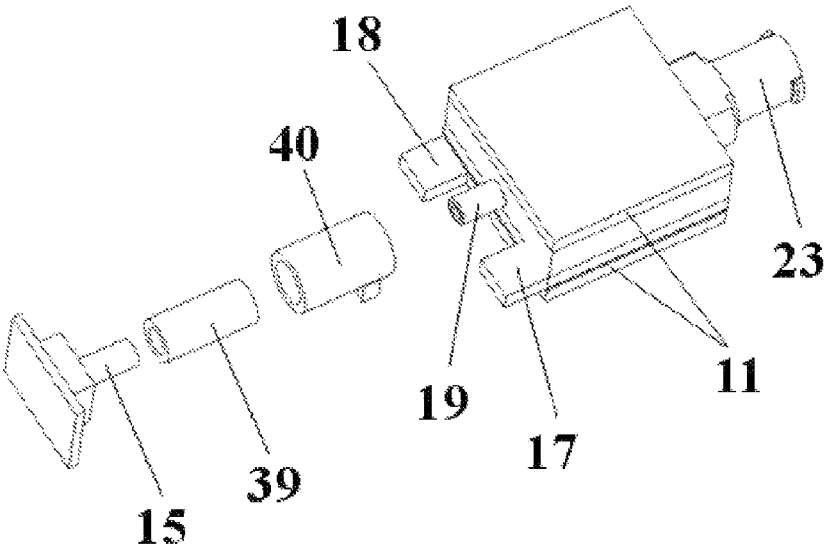
FIG. 6 is an assembly structurally schematic diagram of the pure oxygen generation assembly and the pressure sensor of the present invention.

Referring to FIGS. 4,5 and 6, the pure oxygen generation assembly 11 comprises a porous gas end plate 24, a membrane electrode assembly 25, an oxygen end plate 26, and a gas gathering base 27. The membrane electrode assembly 25 comprises an anode gas diffusion layer 28, an anode catalytic layer 29, a proton exchange membrane 30, a cathode catalytic layer 31, and a cathode gas diffusion layer 32. The porous gas end plate 24, the membrane electrode assembly 25 and the oxygen end plate 26 are sealedly connected with each other in turn. A plurality of small holes 33 are evenly distributed in a middle of the porous gas end plate 24 and face to the cathode gas diffusion layer 32. The cathode gas diffusion layer 32 is connected with the negative electrode of the output end of the external controller 10. An oxygen through-hole 34 is provided at a middle of the oxygen end plate 26 and is communicated with an oxygen output pipe 35. The anode gas diffusion layer 28 is connected with the positive electrode of the output end of the external controller 10. An outer surface of a connecting portion of the membrane electrode assembly 25 with the porous gas end plate 24 and with the oxygen end plate 26 has a package slot. The two package slots are filled with the adhesive 36. The cathode pin 18 extends from the porous gas end plate 24, and the anode pin 17 extends from the oxygen end plate 26.

A whole of the porous gas end plate 24 connected with the membrane electrode assembly 25 and the oxygen end plate 26 is placed on the gas gathering base 27, and is filled with the adhesive via the sealing groove 37 of the gas gathering base 27 for being packaged to the pure oxygen generation assembly 11. The oxygen through-hole 34 of the oxygen end plate 26 is communicated with the oxygen outlet 38 of the gas gathering base 27, and the oxygen outlet 38 is communicated with the oxygen joint 23.

Figure 7:
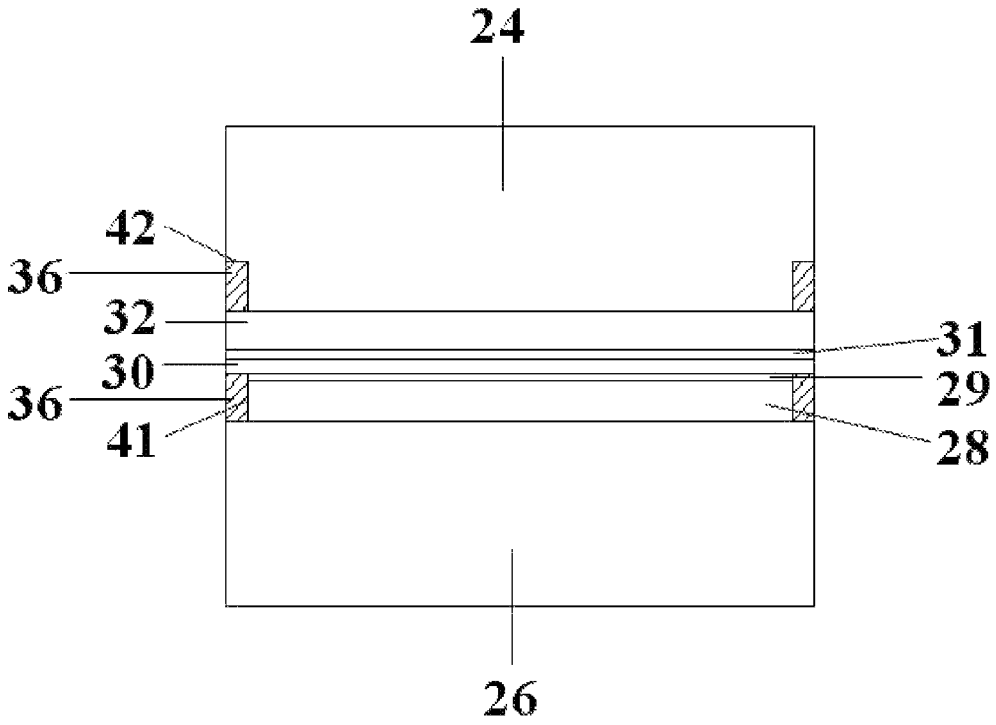
FIG. 7 is a structurally schematic diagram of specifically packaging the porous gas end plate, the membrane electrode assembly and the oxygen end plate according to the first package embodiment of the present invention.

The specific package of the porous gas end plate 24, the membrane electrode assembly 25 and the oxygen end plate 26 is described in the first embodiment, as shown in FIG. 7. An outer surface of the anode gas diffusion layer 28 and the anode catalytic layer 29 of the packaged membrane electrode assembly 25 has an anode package slot 41. An outer surface of a side where the porous gas end plate 24 fits to the cathode gas diffusion layer 32 has a cathode package slot 42. The anode package slot 41 and the cathode package slot 42 are filled with the adhesive 36.

Figure 8:
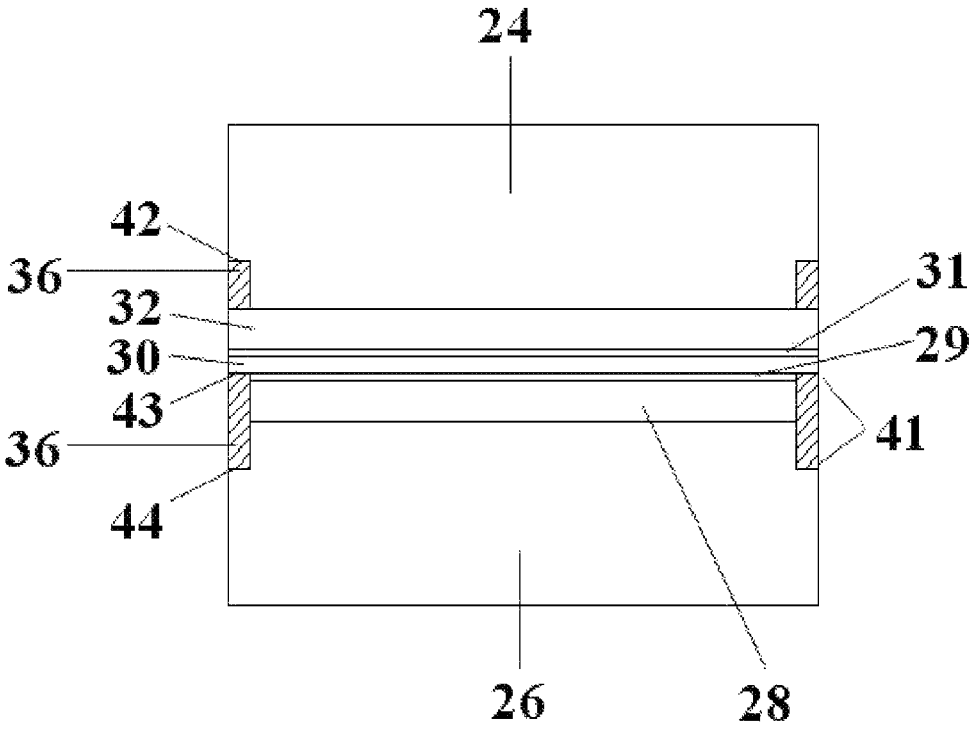
FIG. 8 is a structurally schematic diagram of specifically packaging the porous gas end plate, the membrane electrode assembly and the oxygen end plate according to the second package embodiment of the present invention.

The specific package of the porous gas end plate 24, the membrane electrode assembly 25 and the oxygen end plate 26 is described in the second embodiment, as shown in FIG. 8. An outer surface of the anode gas diffusion layer 28 and the anode catalytic layer 29 of the packaged membrane electrode assembly 25 has an inner anode package slot 43. An outer surface of a side where the oxygen end plate 26 fits to the anode gas diffusion layer 28 has an outer anode package slot 44. The inner anode package slot 43 is communicated with the outer anode package slot 44 to form a whole anode package slot 41. An outer surface of a side where the porous gas end plate 24 fits to the cathode gas diffusion layer 32 has a cathode package slot 42. The anode package slot 41 and the cathode package slot 42 are filled with the adhesive 36.

What is claimed is:

1. A self-breathing electrochemical oxygenerator comprising an outer housing which comprises an upper housing part and a lower housing part, and characterized in that: a cavity formed by the upper housing part comprises a battery installation cavity, a controller installation cavity and an electrochemical assembly installation cavity, batteries are installed within the battery installation cavity, a controller is installed within the controller installation cavity, a self-breathing electrochemical pure oxygen generation assembly is installed within the electrochemical assembly installation cavity, an upper housing body of the upper housing part corresponding to the electrochemical assembly installation cavity has air holes, an upper housing body of the upper housing part corresponding to the controller installation cavity has a display screen assembly hole, a positive electrode and a negative electrode of the battery installation cavity are respectively connected with a positive electrode and a negative electrode of an input end of the controller via leads, a power switch and a pressure sensor are mounted on the controller, an output end of the controller is connected with a display screen, the display screen is inserted into the display screen assembly hole, an anode pin of the pure oxygen generation assembly, a cathode pin thereof, and a pressure educing pipe are respectively connected with a positive electrode and a negative electrode of the output end of the controller, and an input end of the pressure sensor, an oxygen outlet of the pure oxygen generation assembly is communicated with the pressure educing pipe, the lower housing part is mounted on the upper housing part, a joint through-hole and a switch through-hole are respectively provided at two positions where the lower housing part is corresponding to an oxygen joint of the pure oxygen generation assembly and the lower housing part is corresponding to the power switch of the controller, the oxygen joint of the pure oxygen generation assembly penetrates through the joint through-hole of a top surface of the lower housing part, and the power switch of the controller penetrates through the switch through-hole of the top surface of the lower housing part;

the pure oxygen generation assembly comprises a porous gas end plate, a membrane electrode assembly, an oxygen end plate, and a gas gathering base, wherein the membrane electrode assembly comprises an anode gas diffusion layer, an anode catalytic layer, a proton exchange membrane, a cathode catalytic layer, and a cathode gas diffusion layer, the porous gas end plate, the membrane electrode assembly and the oxygen end plate are sealedly connected with each other in turn, a plurality of small holes are evenly distributed in a middle of the porous gas end plate and face to the cathode gas diffusion layer, the cathode gas diffusion layer is connected with the negative electrode of the output end of the external controller, an oxygen through-hole is provided at a middle of the oxygen end plate and is communicated with an oxygen output pipe, the anode gas diffusion layer is connected with the positive electrode of the output end of the external controller, an outer surface of a connecting portion of the membrane electrode assembly with the porous gas end plate and with the oxygen end plate has a package slot, the two package slots are filled with the adhesive.

2. The self-breathing electrochemical oxygenerator, as recited in claim 1, characterized in that: a seal hose is sleevedly mounted to an outer surface of the pressure educing pipe exposing to the pure oxygen generation assembly and an outer surface of the input end of the pressure sensor, and a guide tube is sleevedly mounted to an outer surface of the seal hose.

3. The self-breathing electrochemical oxygenerator, as recited in claim 2, characterized in that: the cathode pin extends from the porous gas end plate, and the anode pin extends from the oxygen end plate.

4. The self-breathing electrochemical oxygenerator, as recited in claim 3, characterized in that: a whole of the porous gas end plate connected with the membrane electrode assembly and the oxygen end plate is placed on the gas gathering base and is filled with the adhesive via the sealing groove of the gas gathering base for being packaged together, the oxygen through-hole of the oxygen end plate is communicated with the oxygen outlet of the gas gathering base, and the oxygen outlet is communicated with the oxygen joint.

5. The self-breathing electrochemical oxygenerator, as recited in claim 1, characterized in that: a square hole is provided at a position where the lower housing part is corresponding to the battery installation cavity, and a battery cover is mounted on the square.

6. The self-breathing electrochemical oxygenerator, as recited in claim 1, characterized in that: a temperature sensor and a humidity sensor are mounted on the controller.

7. The self-breathing electrochemical oxygenerator, as recited in claim 6, characterized in that: the cathode pin extends from the porous gas end plate, and the anode pin extends from the oxygen end plate.

8. The self-breathing electrochemical oxygenerator, as recited in claim 7, characterized in that: a whole of the porous gas end plate connected with the membrane electrode assembly and the oxygen end plate is placed on the gas gathering base and is filled with the adhesive via the sealing groove of the gas gathering base for being packaged together, the oxygen through-hole of the oxygen end plate is communicated with the oxygen outlet of the gas gathering base, and the oxygen outlet is communicated with the oxygen joint.

9. The self-breathing electrochemical oxygenerator, as recited in claim 8, characterized in that: an outer surface of the anode gas diffusion layer and the anode catalytic layer of the packaged membrane electrode assembly has an anode package slot, an outer surface of a side where the porous gas end plate fits to the cathode gas diffusion layer has a cathode package slot.

10. The self-breathing electrochemical oxygenerator, as recited in claim 8, characterized in that: an outer surface of the anode gas diffusion layer and the anode catalytic layer of the packaged membrane electrode assembly has an inner anode package slot, an outer surface of a side where the oxygen end plate fits to the anode gas diffusion layer has an outer anode package slot, the inner anode package slot is communicated with the outer anode package slot to form a whole anode package slot, an outer surface of a side where the porous gas end plate fits to the cathode gas diffusion layer has a cathode package slot.

11. The self-breathing electrochemical oxygenerator, as recited in claim 6, characterized in that: the proton exchange membrane is embodied as a hydrogen ion exchange membrane.

12. The self-breathing electrochemical oxygenerator, as recited in claim 1, characterized in that: the cathode pin extends from the porous gas end plate, and the anode pin extends from the oxygen end plate.

13. The self-breathing electrochemical oxygenerator, as recited in claim 12, characterized in that: a whole of the porous gas end plate connected with the membrane electrode assembly and the oxygen end plate is placed on the gas gathering base and is filled with the adhesive via the sealing groove of the gas gathering base for being packaged together, the oxygen through-hole of the oxygen end plate is communicated with the oxygen outlet of the gas gathering base, and the oxygen outlet is communicated with the oxygen joint.

14. The self-breathing electrochemical oxygenerator, as recited in claim 13, characterized in that: an outer surface of the anode gas diffusion layer and the anode catalytic layer of the packaged membrane electrode assembly has an anode package slot, an outer surface of a side where the porous gas end plate fits to the cathode gas diffusion layer has a cathode package slot.

15. The self-breathing electrochemical oxygenerator, as recited in claim 13, characterized in that: an outer surface of the anode gas diffusion layer and the anode catalytic layer of the packaged membrane electrode assembly has an inner anode package slot, an outer surface of a side where the oxygen end plate fits to the anode gas diffusion layer has an outer anode package slot, the inner anode package slot is communicated with the outer anode package slot to form a whole anode package slot, an outer surface of a side where the porous gas end plate fits to the cathode gas diffusion layer has a cathode package slot.

16. The self-breathing electrochemical oxygenerator, as recited in claim 1, characterized in that: the proton exchange membrane is embodied as a hydrogen ion exchange membrane.

* * * * *